US011523650B2

(12) United States Patent
Jackson

(10) Patent No.: US 11,523,650 B2
(45) Date of Patent: Dec. 13, 2022

(54) HAT TENSION HOLDER AND RELATED METHODS

(71) Applicant: Brennan Jackson, Fallbrook, CA (US)

(72) Inventor: Brennan Jackson, Fallbrook, CA (US)

( * ) Notice: Subject to any disclaimer, the term of this patent is extended or adjusted under 35 U.S.C. 154(b) by 55 days.

(21) Appl. No.: 17/344,263

(22) Filed: Jun. 10, 2021

(65) Prior Publication Data

US 2021/0386152 A1 Dec. 16, 2021

Related U.S. Application Data

(60) Provisional application No. 63/039,891, filed on Jun. 16, 2020.

(51) Int. Cl.
*A42B 1/24* (2021.01)
*A42B 1/247* (2021.01)

(52) U.S. Cl.
CPC ..... *A42B 1/24* (2013.01); *A42B 1/247* (2013.01)

(58) Field of Classification Search
CPC ..... A42B 1/24; A42B 1/247; A42B 1/004; A42B 1/02; A42B 1/018; A42B 1/241; A42B 1/248; A42B 3/0406; A42B 3/04; A42B 3/30; A42C 5/00; A42C 5/02; A42C 99/00; A41D 27/08; A41F 1/00; Y10T 24/1391; Y10T 24/13; Y10T 24/1303; Y10T 24/1371; Y10T 24/1376; Y10T 24/1397
USPC ..... 2/244, 245, 246, 265
See application file for complete search history.

(56) References Cited

U.S. PATENT DOCUMENTS 573,906 A * 12/1896 McRae ..... A41F 11/02 2/265
862,795 A * 8/1907 Blackiston ..... A42B 1/247 2/10
890,530 A * 6/1908 Ross ..... A42B 1/248 24/340
899,685 A * 9/1908 Seyfried ..... A42B 7/00 132/68.1
903,037 A * 11/1908 Westlund ..... A42B 7/00 2/175.7
1,216,635 A * 2/1917 Washington ..... A42B 1/247 2/10
1,499,858 A * 7/1924 Davis ..... A42B 1/24 43/57.1
1,641,812 A * 9/1927 Johnson ..... A42B 1/24 40/329
1,678,198 A * 7/1928 Rehder ..... A42B 1/24 43/57.1

(Continued)

FOREIGN PATENT DOCUMENTS

GB 000009360 A * 5/1909
GB 000006860 A * 4/1914
JP 2010229609 A * 10/2010 ..... A42B 1/247

*Primary Examiner* — Amy Vanatta
(74) *Attorney, Agent, or Firm* — KOS IP Law LLP

(57) ABSTRACT

A holder for holding an item in place relative to a hat and a hat having a holder. The holder generally comprises a spring, a platform, and at least one string coupled to both the spring and the platform. The spring is generally disposed within an interior cavity of the crown of the hat while the platform is disposed in front of the exterior surface of the crown, while a string joins the two. The platform can then be pulled away from the crown to receive an object to retain the object to the hat.

19 Claims, 8 Drawing Sheets

(56) References Cited

U.S. PATENT DOCUMENTS

| | | | | | |
|---|---|---|---|---|---|
| 2,222,096 | A * | 11/1940 | Walthour, Jr. | A42B 1/24 | 43/57.1 |
| 2,838,868 | A * | 6/1958 | Young | A01K 97/06 | 43/57.2 |
| 4,304,005 | A * | 12/1981 | Danley, Sr. | A42B 1/247 | 2/10 |
| 6,170,088 | B1 * | 1/2001 | Tate | A63B 57/35 | 2/200.1 |
| 6,175,963 | B1 * | 1/2001 | Loeffelholz | A42B 1/248 | 2/200.1 |
| 2006/0268221 | A1 * | 11/2006 | Tracy | A42B 1/247 | 351/155 |
| 2022/0142282 | A1 * | 5/2022 | Ferrara | A42B 1/247 | |

* cited by examiner

HAT TENSION HOLDER AND RELATED METHODS

FIELD OF THE INVENTION

The present invention relates to hats. More particularly, embodiments of the invention relate to devices used to hold items in place relative to a hat and related methods.

BACKGROUND

Hats are common clothing items that people wear on their heads. While the cavity of a hat is made to fit on a wearer's head, some hat owners may remove the hat and turn it over to place items, like keys or wallets, inside the hat cavity when the wearer is not wearing the hat. Other hat owners may use the hat to hold items while the wearer is wearing the hat, such as in the crown of a cowboy hat or balanced on the bill of a baseball cap.

There is a need for improved systems and methods to comfortably allow a hat wearer to hold items on their hat while wearing the hat.

BRIEF DESCRIPTION OF THE FIGURES

These and other features and advantages of the present devices, systems, and methods will become appreciated as the same becomes better understood with reference to the specification, claims and appended drawings wherein:

DETAILED DESCRIPTION

Figure 1:
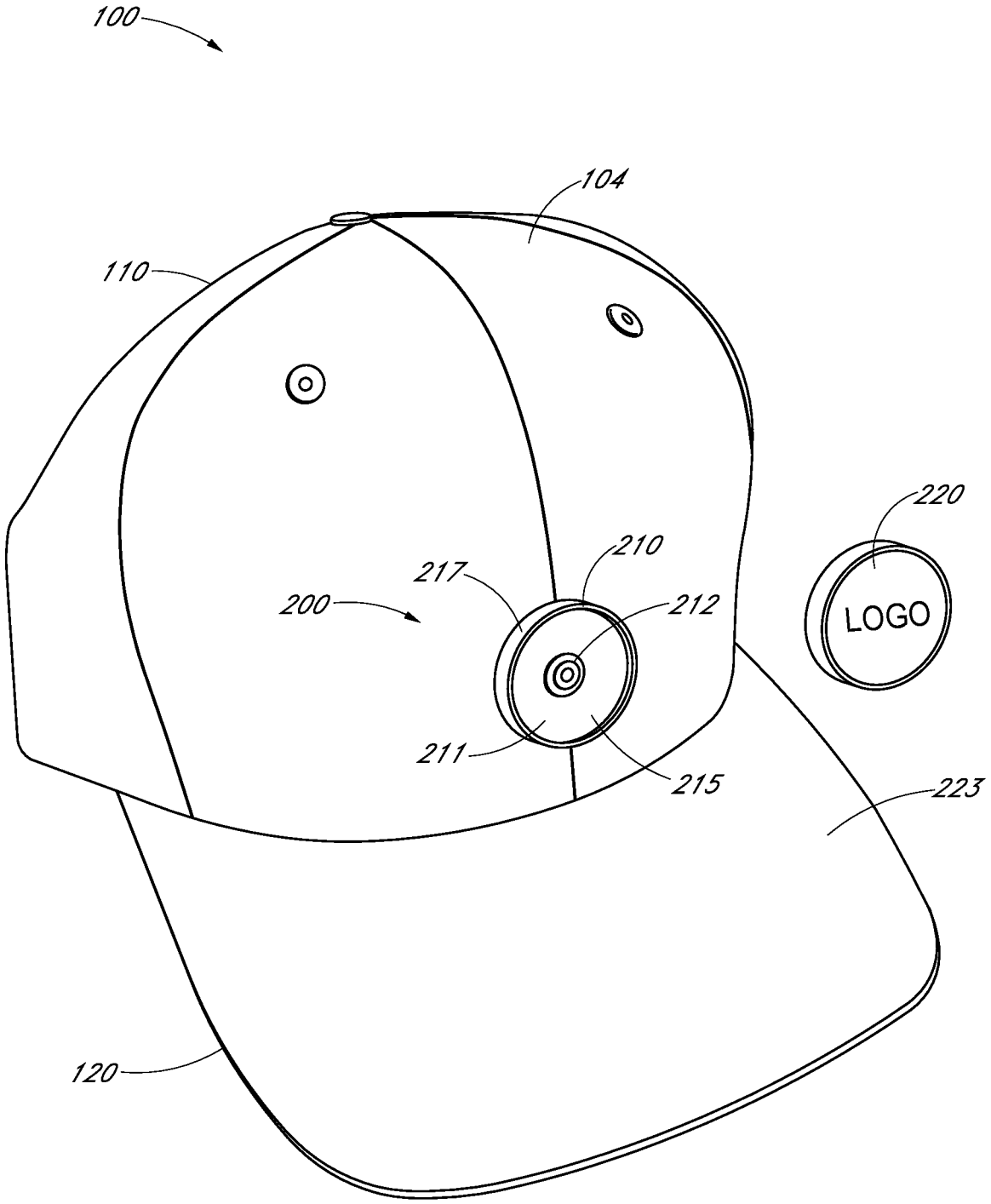
FIG. 1 shows a front perspective view of a hat having a holder coupled to a front of the crown of the hat.

The detailed description set forth below in connection with the appended drawings is intended as a description of the presently preferred embodiments of a hat tension holder and a hat having a tension holder provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

FIGS. 1-6 show an embodiment of a hat 100 having a crown 110, a brim 120, and a holder 200 coupled the crown 110 designed to hold a pair of sunglasses 400 (FIG. 5) in place with respect to the hat 100. While the hat 100 is shown as a baseball cap, or baseball-style cap, having a crown 110 comprising and a brim 120 extending from one side of the crown 110, any hat could be used with the holder 200, such as a cowboy hat or a bucket hat. The hat 100 can comprise a plurality of panels 104 and can be a fitted hat or an adjustable hat having an adjustable strap for adjusting the opening size of the crown.

In an example, the holder 200 comprises a platform 210 and a spring 240 coupled to one another via a string 230 (FIGS. 2 and 4), which threads or projects through a hole 112 located in the crown 110. The hold forms a passageway between the interior of the crown 110 and the exterior of the crown 110. While the hole 112 is shown as a hole made in between two panels 104, 104 of the crown 110, the hole 112 could be made in the middle of a panel, through the material of the crown, or in the middle of the brim 120 in other embodiments, particularly where the crown does not contain a plurality of panels. The hole 112 is preferably centrally located at the front of the hat, above the brim 120, when mounting the platform 210 to the front of the hat 100. In other examples, the hole 112 can be located on the crown 110 at a location 180 degrees from the front when mounting the platform 210 to the back of the hat to hold an object, such as a pair of sunglasses, to the back of the hat.

In some embodiments, the string 230 could be configured to thread through an existing hole made in a hat, such as through a reinforced eyelet 114 formed in a panel of crown 110, or through a strategically placed reinforced eyelet for cooperating with the holder 200, or elsewhere on the hat. The string 230 is configured to secure the platform 210 to a spring mechanism located inside the hat, as further discussed below.

The platform 210 is understood as a structure sized and shaped to provide a physical barrier or constraint to an object to hold the object to a hat. The object can be a pair of sunglasses or any object that can fit between the platform 210 and the crown of the hat. As shown, the platform 210 comprises a substantially cylindrical shape base or body 215. However, the platform 210 could embody any suitable shape designed to hold an item in place relative to hat 100, such as a square prism, a triangular prism, other polygonal shaped or irregularly shaped platforms. The platform 210 could made of any material suitable to hold an item, such as plastic, metal, wood or combinations thereof, and could be configured to have a surface that is elastic or soft to prevent damaging an item when holding it in place, such as a surface that is covered by a microfiber cloth, or a surface that is covered by an elastic or rubber foam. In some embodiments, the entirety of platform 210 could comprise an elastic material designed to hold an item in place without damaging the item, such as a stiff rubber or foam or a soft thermoplastic elastomer material. The platform 210 can be stamped, molded, machined, or cut into final shape.

In an example, the body 215 of the platform 210 comprises a magnet 212 and a lip 217 defining a recess 211 that is sized and disposed to accept a ferrous sign or marker 220, which is magnetically held in place within the front recess 211 via a magnetic coupling. In some embodiments, the sign or marker 220 is not made of a ferrous material and is held in place with respect to the platform 210 via another mating mechanism, such as a snap button, with matching indents and detents, or adhesive. In other examples, the lip 217 can be omitted and the body 215 presents a generally flat planar surface for connecting to the marker, such as through magnetic coupling, detents, Velcro, adhesive, or combinations thereof.

The marker 220 can be removable from the body 215 of the platform or be permanently secured to the body. By using a platform 210 in which the marker 220 can separate from the body or base 15 of the platform 210, the marker 220 can be replaced or exchanged with a different marker, thus allowing a user to select a marker with the design to the user's liking to couple to the body of the platform. In some examples, the entirety of the platform 210 can be a one-piece marker having any number of shapes and designs, such as a wooden structure with a fish shape cut-out or an oval shaped wooden structure with a picture and/or text emblazoned or printed on an exterior surface of the one-piece structure. One or more holes can be provided through the one-piece structure for attachment to the string 230.

The sign or maker 220 can have a body 223 having a corresponding shape as the body or base 215 of the platform 210. In other examples, the body of the marker can have a different shape than the shape of the base 215. For example, the base 215 can serve as a universal unit that can couple to any sized or shaped marker by providing a magnet with the base to attract any shaped marker having a ferrous material. In an example, the marker 220 can have a logo so that when the marker is coupled to the base 215, the logo can be prominently displayed on the front of the hat 100.

Figure 2:
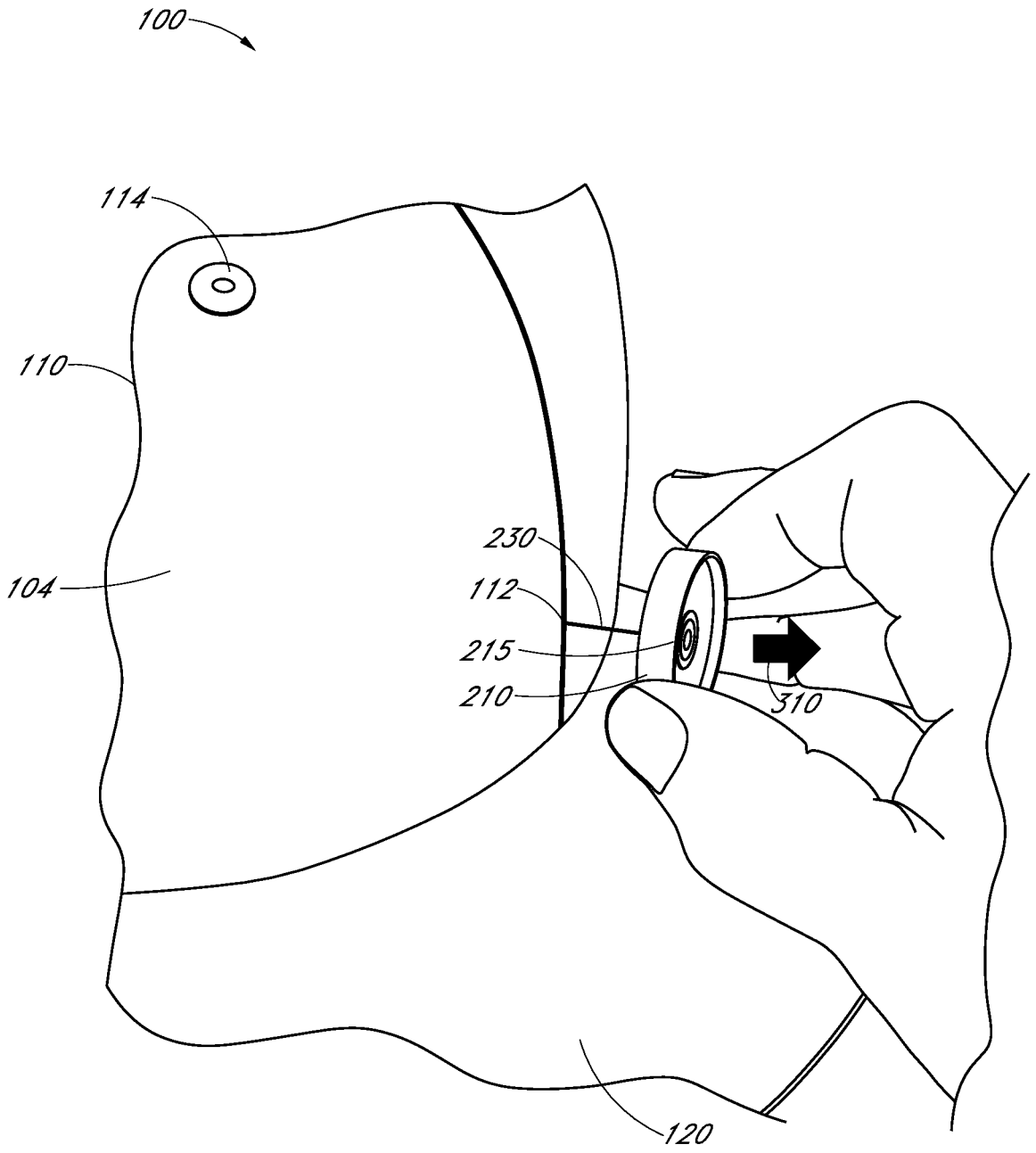
FIG. 2 shows a front perspective view of the hat of FIG. 1 with the holder pulled away from the crown of the hat.
Figure 6:
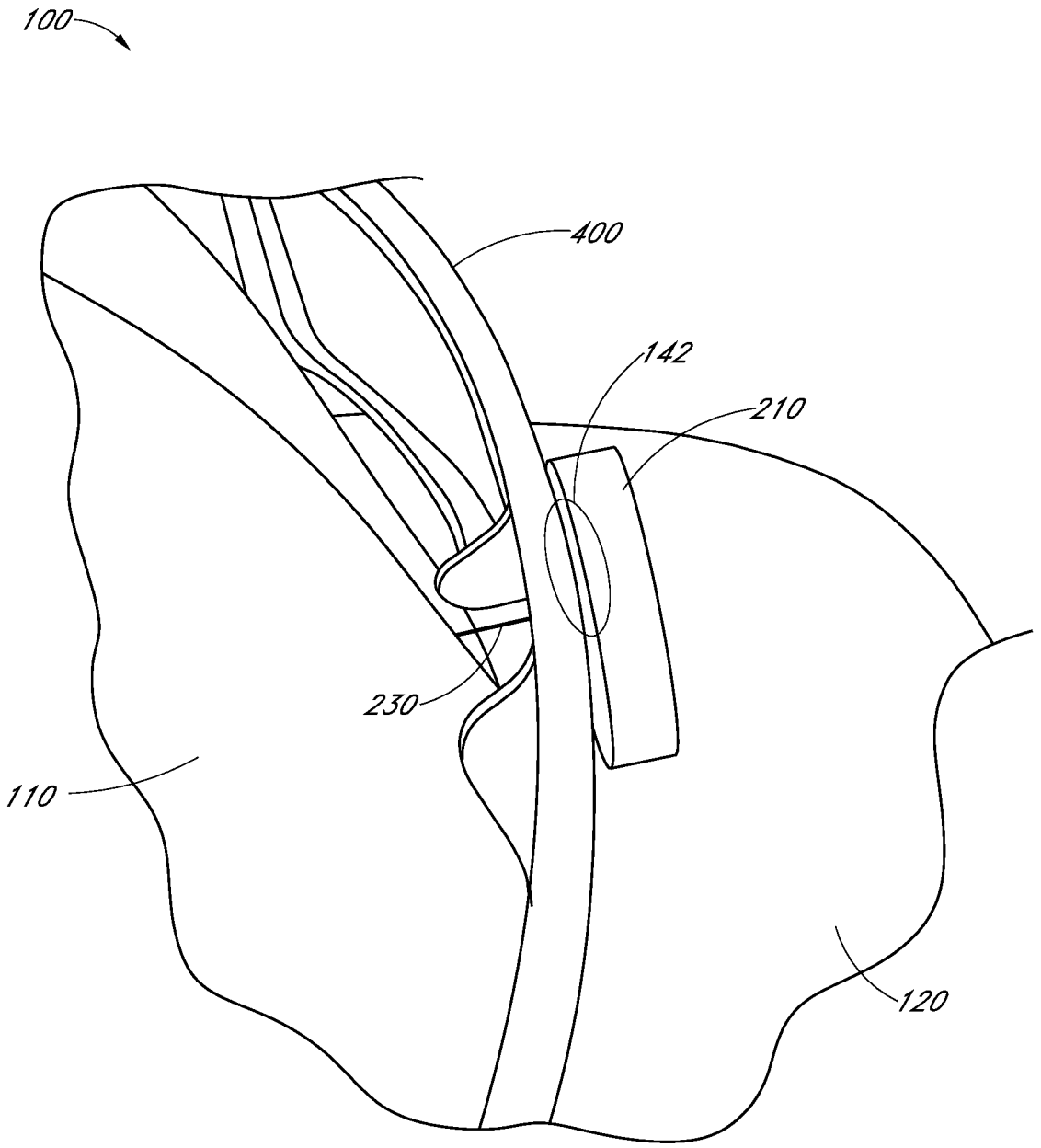
FIG. 6 shows a top perspective view of the hat of FIG. 5.

In other examples, the marker can have a different insignia than a logo, thus allowing a user to change a logo or a look and feel of the holder 200 by switching the sign or insignia that is coupled to the platform 210. For example, during an election season, similar hats can be used by different candidates but wherein each candidate can have a specific marker for use with the hat to distinguish from hats used by other candidates. In still other examples, a picture, text, or other message can be provided with the sign 220 instead of a logo. While in some embodiments the sign 220 could be designed to have a recess that accepts a portion of platform 210, in preferred embodiments the platform 210 has a recess that accepts the sign 220. When the body or base 215 of the platform has a lip defining a recess, the user will more likely grip the base with the sign located in the recess to avoid having the sign 220 dislodging from the base when a user pulls the platform 210 away from the front surface of the crown 210 as shown in FIG. 2. In still other examples, the platform 210 and the marker 220 can be integrally formed or permanently secured to one another such that the marker 220 cannot separate from the base 215. In some examples, a clip or a strap can be provided in combination with the holder to further secure the object to the holder. For example, a hook and loop fastener may be provided to wrap around the object and the platform and/or cap to secure the object to the holder. As another example, a clip similar to a spring-loaded clamp is provided at the back of the platform for positively engaging the eyeglass frame. In still yet another example, the rear upper end of the platform 210 can include one or more tabs or ridges 142 that extend over the top of the frame of the eyeglasses (FIG. 6, shown schematically) when the frame is placed in the gap between the platform and the hat.

In FIG. 2, a force 310 is shown that is applied to the platform 210, such as by the user's hand, to pull the platform 210 away from the front surface of crown 110. The force needed to pull the platform away from the cap is higher than the spring force that maintains the string in a retracted position inside the cap. Applying the pulling force 310 to the platform 210 pulls on the string 230 connected to the platform, which then compresses the spring 240 by causing the string to connected to the spring to pull on the first end 232 and the second end 234 of the spring, as further discussed below. After the platform 210 is pulled and the spring is flexed, a gap (FIG. 2) is provided to then slip the bridge of the eyeglass frame around the string and behind the holder. The holder 200 is then slowly released so that the spring pulls back on the platform 210 to squeeze the eyeglass frame between the platform 210 and the crown 110.

Figure 3:
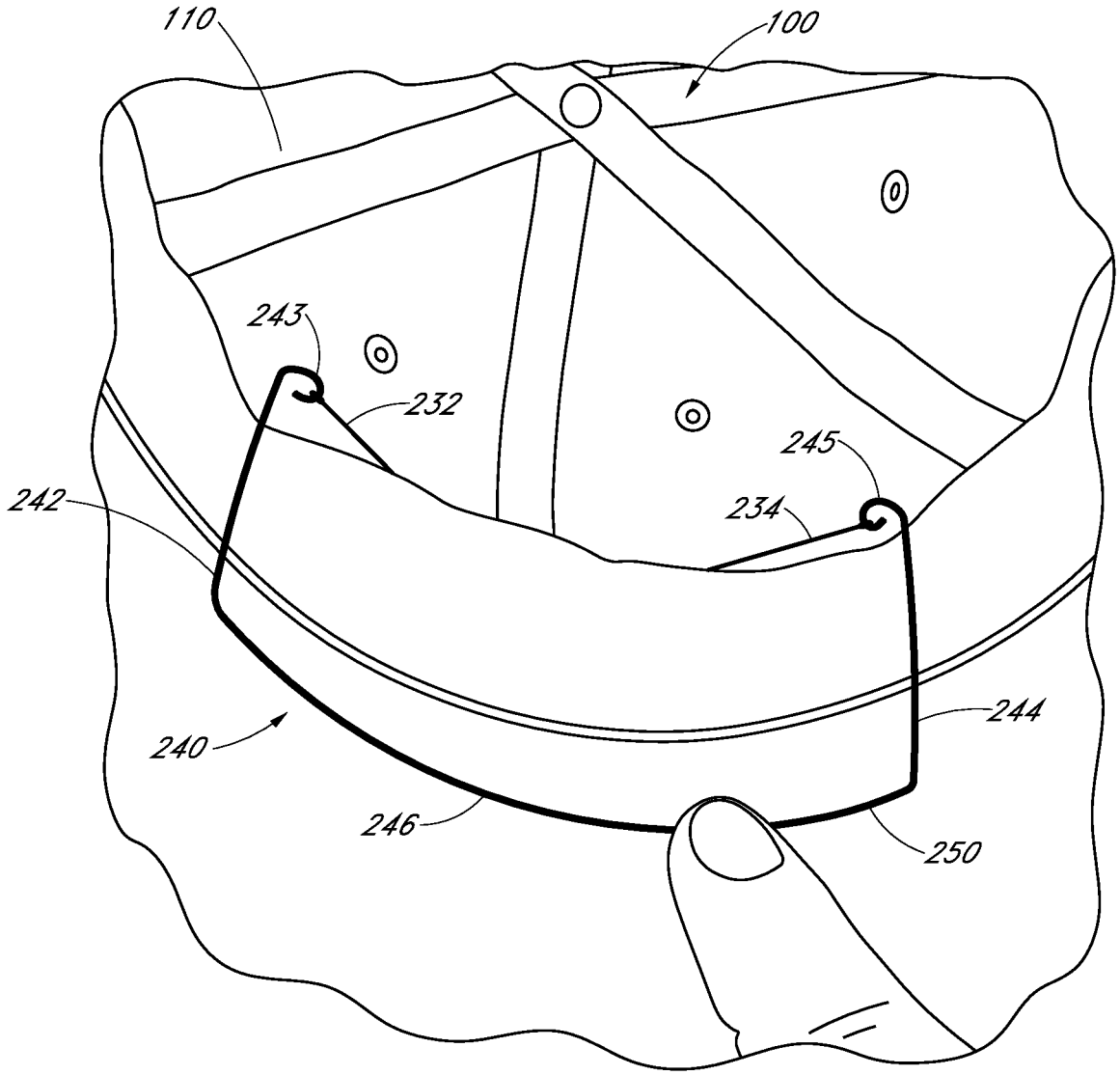
FIG. 3 shows a bottom perspective view of an interior cavity of the crown of the hat of FIG. 1 with a spring of the holder coupled to a string.
Figure 4:
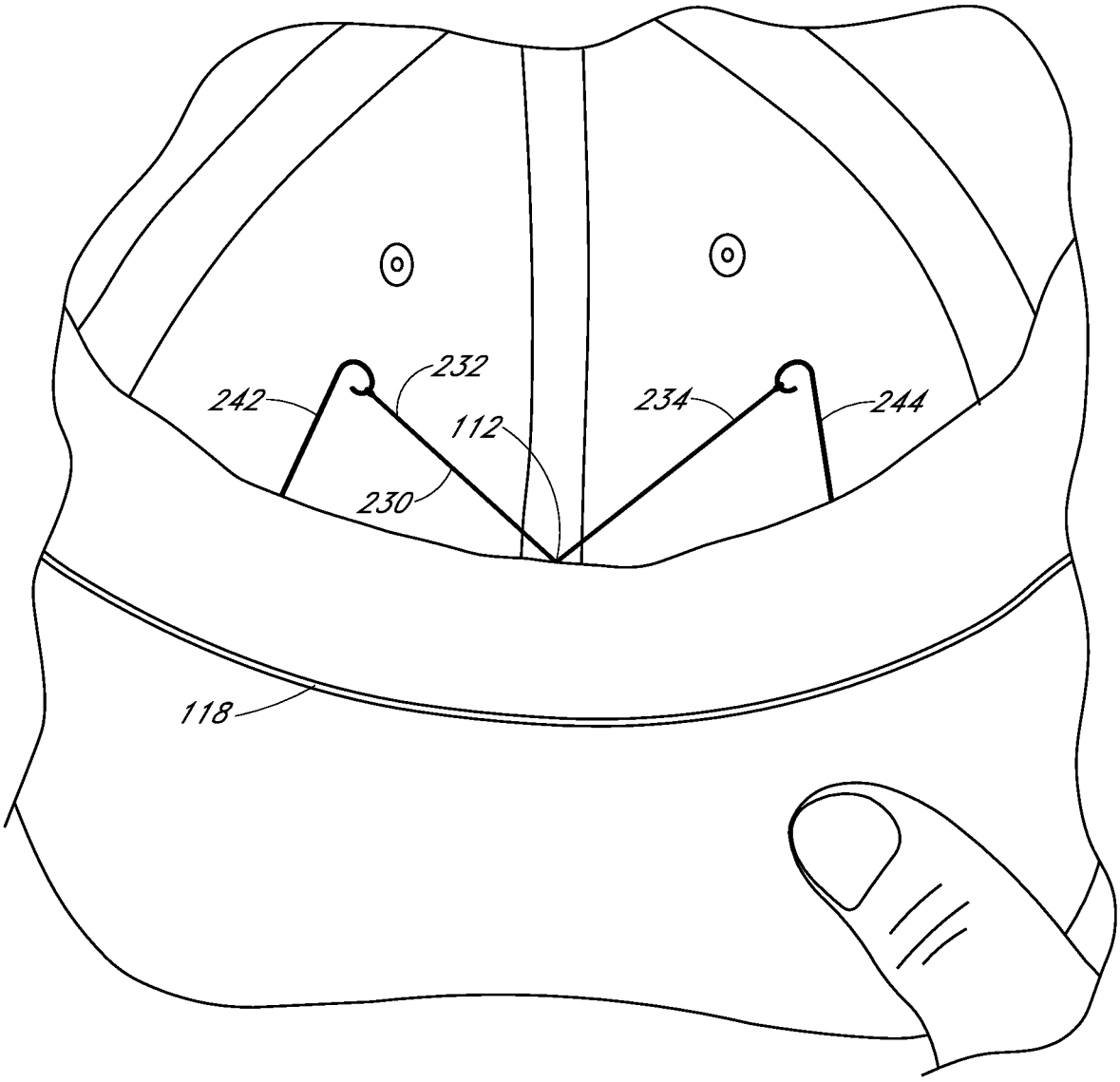
FIG. 4 shows a bottom perspective view of the hat of FIG. 3 with the spring of the holder tucked into an inner crown pocket of the hat.
Figure 5:
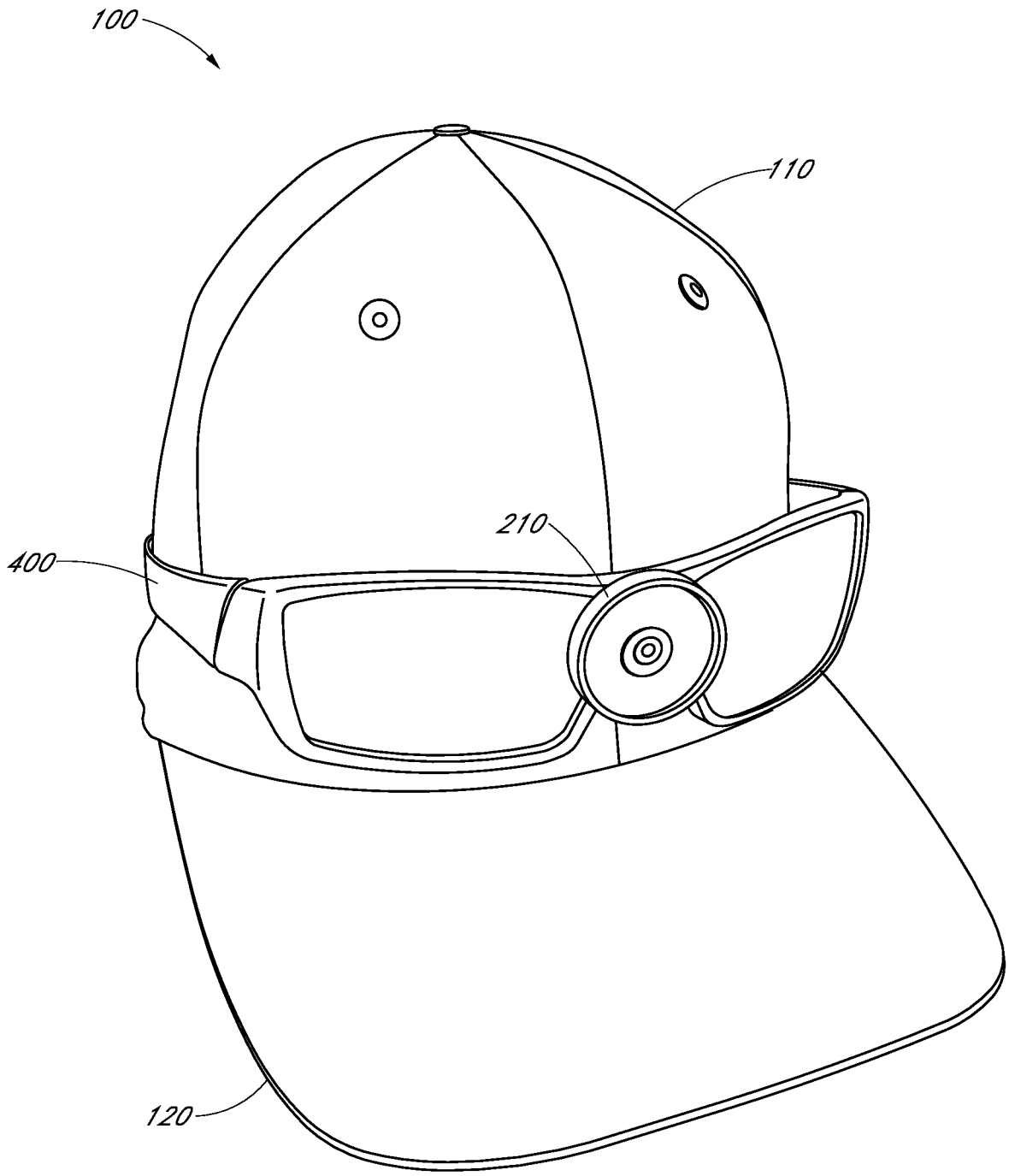
FIG. 5 shows a front perspective view of the hat of FIG. 1 with a pair of sunglasses held against the crown of the hat by the holder.

With specific reference to FIGS. 3 and 4, the spring 240 in accordance with aspects of the invention can be a wire 250 having resilient properties. When the wire is flexed it exerts a counterforce to unflex, otherwise known as elastic deformation, which provides the spring force needed for the holder of the present invention. The wire 250 can be shaped or bent to take on a particular configuration or shape to define a spring. When the spring is flexed from its formed shape, it tends to unflex to generate a counter force.

Exemplary springs can be made from music wire, plastic, a wire shaft, an elastic band, or a coiled spring attached to a frame. As shown, the spring 240 is a music wire of about 6 gauge to about 24 gauge. The spring 240 is generally U-shape having a base or anchor 246 and two side arms 242, 244. In an example, the anchor 246 can be about four inches in length, and each of the two arms 242, 244 can extend at an angle to the base 246 and having an arm length of about 2.5 inches from a reference plane defined by the anchor. However in other configurations, the lengths, thicknesses, and materials could differ in alternative embodiments. In some embodiments, the anchor 236 is bent or arc to follow the curvature of the lower circumference of the crown 110 of the hat 100, which can the fit of the anchor 236 when placed within pocket 118 of the hat 100.

When the arms 242, 244 of the spring 240 are biased or forced to move together, such as when pulling on the body of the platform 210 with a pulling force 310 (FIG. 2), they are biased or loaded to move away from one another to return to their more relaxed state. As the arms 242, 244 pull away from one another, the spring 240 will then pull on the string 230 (FIG. 4) in the opposite direction from the user pulling direction. Since the string 230 is connected to the platform 210, the string pulls the platform towards the front surface of crown 110. In the retracted position of FIG. 1, a slight tension should be exerted by the spring 230 on the string 230 so as to bias the platform 210 against the front surface of the crown 110. The tension can be generated by tensioning the string 230 slightly and not having any slack or looseness in the string in the retracted position.

A user can pull on the platform 210 away from the surface of the crown 110 to provide a gap (FIG. 2) between the surfaces of the platform and the crown for placement of the eyeglasses, which causes the arms to pull towards one another while biased to move away from one another (FIG. 4). This biasing force can then be used to hold the pair of sunglasses 400 in place against the front surface of crown 110 (FIGS. 5 and 6), preventing the pair of sunglasses 400 from easily dislodging from its resting place on top of the brim 120. As shown in FIG. 6, when the pair of sunglasses 400 is placed in between platform 210 and the front of crown 110, the pulling force from string 230 is exerting a constant pulling pressure to the front of sunglasses 400 via the back of the platform 210 to hold the pair of sunglasses 400 in place. In an example, a clip or a tab can be provided with the platform 210 to positively grip the frame when the frame is stowed atop the brim 120.

The spring 240 (FIGS. 3 and 4) comprises a bent or shaped wire 250 having an anchor or base 246 and two arms 242, 244. Each of the arms 242, 244 has an end 243, 245, respectively. Each arm end is preferably shaped to easily receive an end of at least one string 230, such as string ends 232. 234. As shown, each of the two arm ends 242, 244 can terminate in a hook and the string ends 232, 234 can thread through respective hooks to loop the string ends to the two arms 242, 244 in order to couple the string to the spring. The end of arms 242 and 244 could be shaped in any suitable manner to provide a convenient coupling configuration for the string, such as a loop, a coil, or a knot. In some examples, the string can be used as two separate string sections so that each string section is connected to a respective spring arm and to the platform. In other examples, two strings are used in a double-up manner. In some examples, the spring can be made from plastic and the arm ends can optionally have enclosed loops.

The two arms 242 and 244 are biased away from one another to pull at the string ends 232, 234 of string 230 in the retracted position and particularly when a force, such as a pulling force 310 (FIG. 2), is exerted on the string 230. This provides a retracting force on the platform 210 when the platform 210 is pulled away from the front surface of crown 110, which in turn provides a force that helps to hold an item in place against crown 110 when the item is placed between platform 210 and the front surface of crown 110.

While the arms 242 and 244 are shown as biased away from one another, the arms could be biased in any suitable manner to provide a retractive force, such as in a coil or towards a bottom of the anchor 246. In some embodiments, the string 230 comprises a braid of two or more materials to improve the durability and elasticity of string 230 when in use. The string can alternatively be made from nylon, cotton, natural fibers such as hemp string, and polyester thread, among others.

The base or anchor 246 is shown as a middle portion of the spring 240, located between the two arms 242, 244. The two arms and the anchor can be formed from a single metal wire with multiple separate wire sections contemplated. In use, the anchor 246 can tuck into inner pocket 118 of the crown 110, which is typically a liner formed with the cap. Where a cap or a hat is without a pocket, a strip of liner with bonding material can be provided to adhere to the hat to then create a pocket in the interior of the crown. The strip of liner should be sufficiently long and wide to accommodate the spring 240.

In some embodiments, the anchor 246 has a major axis that is at least 1-in (inch), 2-in, or 3-in in length, which provides a large amount of surface area relative to inner pocket 118, allowing friction forces to hold the anchor 246 in place within inner pocket 118. In some embodiments, the length of the anchor 246 is longer than the length of either arm 242 or 244 but can be the relative lengths can be reversed. In other embodiments, spring can be formed from a large gauge wire or a large diameter plastic, which provides additional stability within the pocket. In still other embodiments, for a hat without a pocket, a coupling mechanism could hold the anchor 246 in place relative to crown 110, such as an adhesive, a magnet, a zipper, or a series of buttons.

Figure 7A:
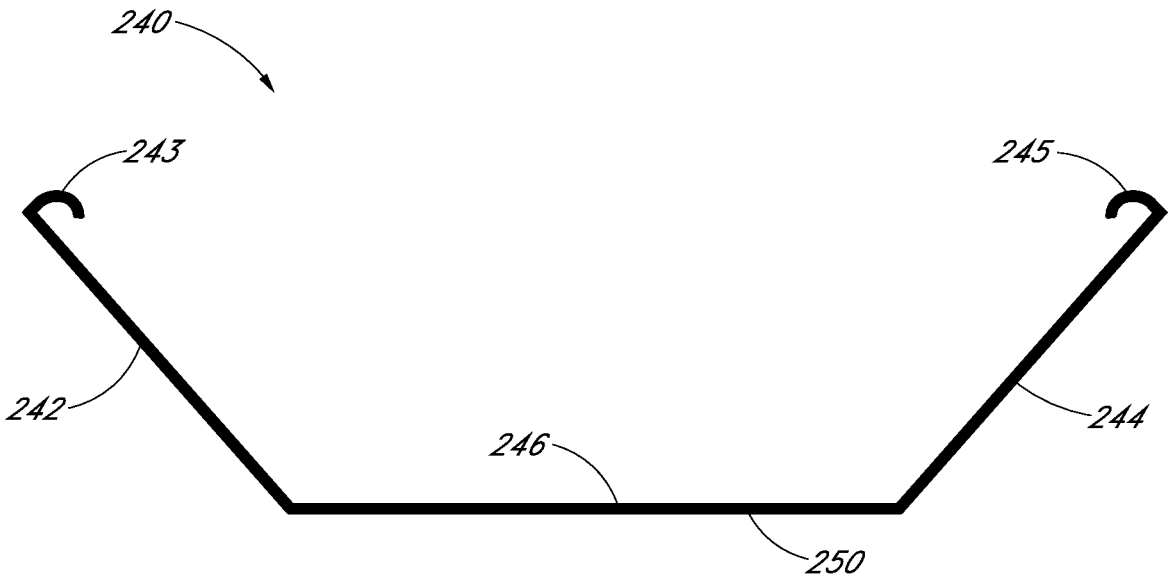
FIG. 7A-7B show plan views of the spring of FIG. 3 with and without a pinching force applied to the spring.
Figure 7B:
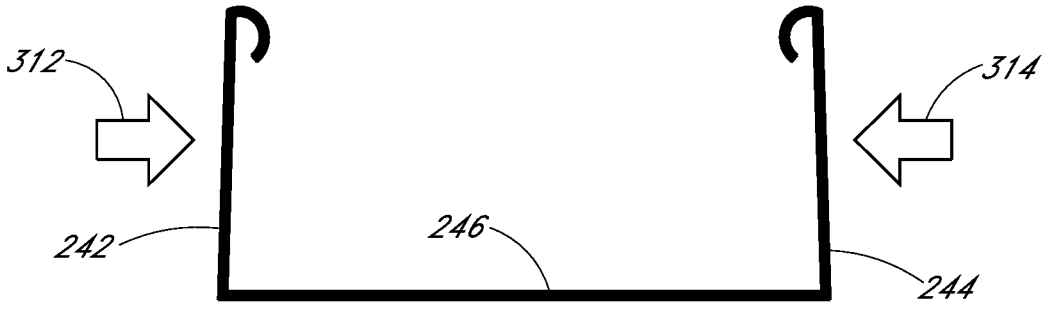

FIGS. 7A and 7B illustrate different configurations of the spring 240, without force exerted on spring 240 in FIG. 7A and with forces 312, 314 exerted on the arms 242, 244 of the spring 240 in FIG. 7B, such as when pulled together by a string. As shown, the spring 240 comprises a wire 250 having two arms 242 and 244 that are formed in an outwardly spaced configuration from one another when no force is exerted on the spring 240. When a pinching force, such as forces 312, 314, is exerted on the arms 242 and 244, the spring 240 compresses to apply a counter-force or a biasing force. The arms 242, 244 moving together (FIG. 7B) is representative of when one or more strings are connected to the ends of the arms 242, 244 and to a platform and tension is supplied by the constraint on the string.

Figure 8A:
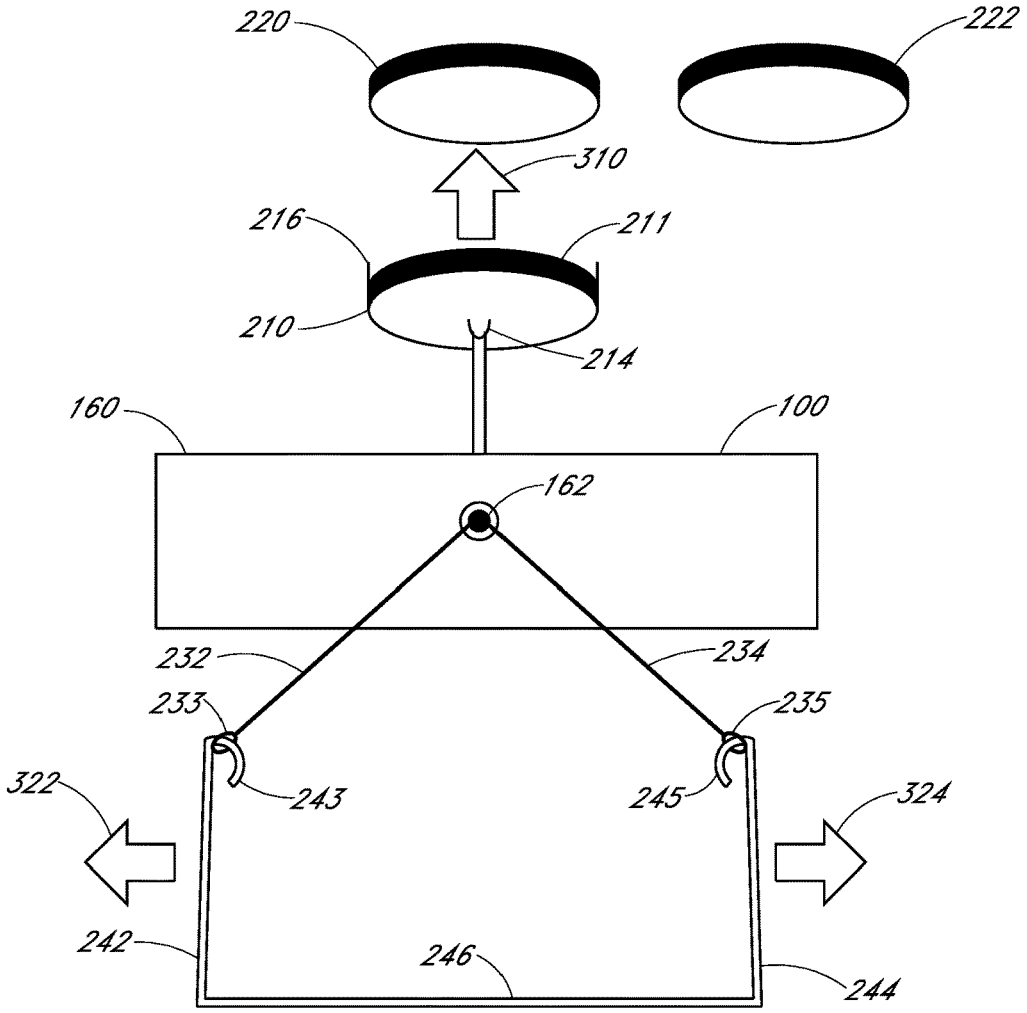
FIG. 8A-8B show exploded views of a holder mounted to a crown wall.
Figure 8B:
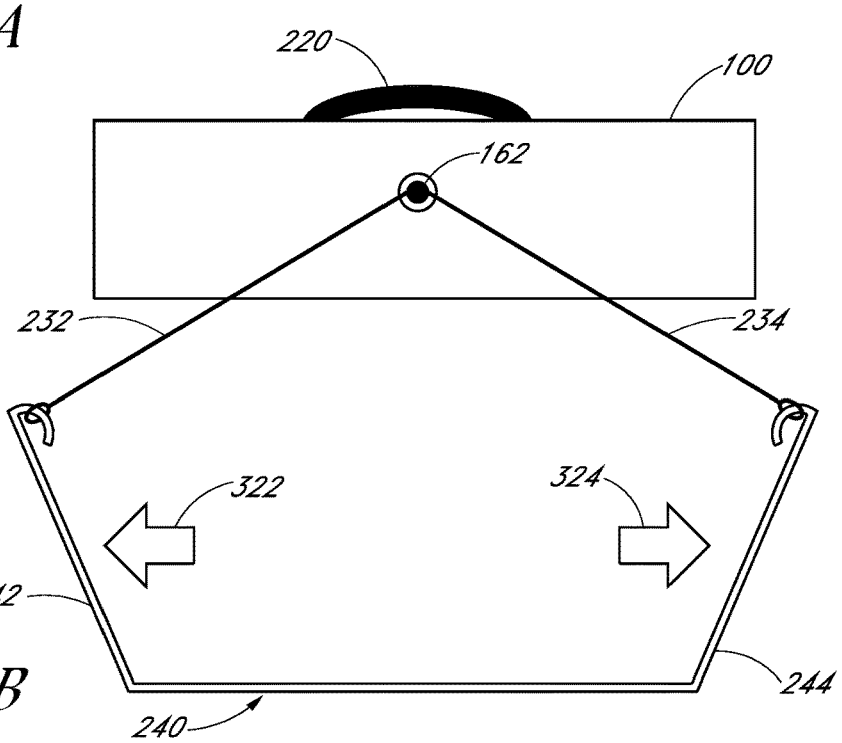

As shown in FIGS. 8A and 8B, when the arms 242 and 244 are compressed or biased towards one another, the spring 240 will exert a counter forces or bias forces 322, 324 on the string ends 232, 234 of the string 230, which in turn pulls on platform 210. Here, the string 230 is threaded through an eyelet 162 of the crown panel 160 (shown as representative of the crown or front of a hat). The eyelet 162 can be a reinforced eyelet and can comprise a hole reinforced with a metallic ring or reinforced with waved threads that allows the string 230 to slide against the surface of the reinforced eyelet. Preferably, the reinforced eyelet 162 has a metallic ring so that sliding action of the string through the eyelet is smooth and with reduced friction.

The string 230 threads through a loop 214 disposed on the rear surface of platform 210, allowing a single string to be used to couple to the arm ends 243, 245 of the two arms 242, 244, respectively. Instead of a loop 214, two through holes can be provided through the body of the platform 210 to string to loop through the platform. The string ends 232, 234 can thread through the loops at the arm ends 243, 245 and then tied off to form eyelets 233, 235 at the ends of string ends 232, 234. In some embodiments, multiple strings could be used to couple the platform 210 to the spring 240. For example, one string could be coupled to the loop 214 of the platform and to the left or first arm end 243, while another string could be coupled to loop 214 and the right or second arm end 245.

The platform 210 has a wall or lip 216 that extends forward from a perimeter of the front surface of the platform 210 to form a recess 211. The recess 211 is sized and disposed to receive a number of different signs or markers 220, 222, one at a time. As mentioned above, one or each of the platform 210, sign 220, and sign 222 can comprise a magnetic material that helps to couple the platform 210 to the sign, such that the sign does not easily separate from the platform. In an alternative embodiment, the sign and platform can be an integrated or unitarily formed piece that does not separate.

Once a sign has been coupled to the platform, a pulling force 310 can be exerted on the platform 210 to create a gap between the platform 210 and the hat 100, which generates counter forces or bias forces 322, 324 to pull platform 210 (and hence the sign 220 in FIG. 8B) towards the front surface of panel 160, allowing the rear surface of platform 210 to rest against the front surface of panel 160 and the string (or strings if two different strings) to be in tension. If any items are placed between the rear surface of platform 210 and the front surface of the panel 160 before releasing force 310 from the platform 210, the item, such as an eyeglass frame, would be held in place with the friction force.

In an alternative embodiment, the spring comprises an anchor and a pair of arms. Two elastic bands or sections with each elastic band or section attached to a respective end of one of the two arms. A string is then attached to a platform and to the two elastic bands or sections. Thus, the biasing forces can be generated by the elastic bands or sections, and optionally also by the two arms of the spring. In some examples, the string can comprise two or more spring sections instead of a continuous string.

Methods of making and of using the holder system and a hat with a holder system and components thereof are within the scope of the present invention.

Although the invention has been discussed with respect to various embodiments, it should be recognized that the invention comprises the novel and non-obvious claims supported by this disclosure.

What is claimed is:

1. A holder for a hat, comprising:

a spring comprising an anchor and a pair of arms biased to pull away from one another, the anchor being sized and shaped to fit within an inner crown pocket of a hat;

a platform having a front surface and a rear surface; and at least one string;

wherein the at least one string is coupled to the pair of arms of the spring and to the platform; and wherein the at least one string is in tension.

2. The holder of claim 1, wherein the spring is made from a metal wire.

3. The holder of claim 2, wherein the anchor is located between the pair of arms.

4. The holder of claim 1, wherein each of the pair of arms terminates in a hook used to hold a loop of the at least one string.

5. The holder of claim 1, wherein the at least one string comprises a flexible plastic.

6. The holder of claim 1, wherein the platform comprises a circular disc.

7. The holder of claim 1, wherein the platform comprises a recess disposed to interchangeably receive a first ferrous sign and a second ferrous sign in a magnetic coupling.

8. The holder of claim 1, wherein the rear surface of the platform comprises a microfiber cloth.

9. The holder of claim 1, wherein the platform comprises two through holes.

10. A hat and a holder combination comprising:

a crown that defines a cavity;

a brim that extends from a lower edge of the crown;

a spring comprising an anchor and a pair of arms biased to pull away from one another and wherein the anchor is tucked within an inner crown pocket of the hat;

a platform disposed exteriorly of the hat above the brim; and at least one string coupled to the platform and each of the pair of arms of the spring; and wherein the spring pulls on the at least one string to pull the rear surface of the platform towards an outer surface of the crown.

11. The hat and holder combination of claim 10, wherein the crown comprises a plurality of panels, and wherein the at least one string threads through a junction between two of the plurality of panels.

12. The hat and holder combination of claim 10, wherein the crown comprises at least one panel having an eyelet, and wherein the at least one string threads through the eyelet.

13. The hat and holder combination of claim 12, wherein the eyelet comprises a metal ring defining a reinforced eyelet.

14. The hat and holder combination of claim 10, wherein the anchor comprises at least a two-inch length of material having a major axis angled from each of the pair of arms by at least thirty degrees.

15. The hat and holder combination of claim 10, wherein each of the pair of arms terminates in a coupling device that mates with at least one end of the at least one string.

16. The hat and holder combination of claim 10, further comprising a first sign comprising a wall surface and a second sign comprising a wall surface that couple to the platform, serially, via a coupling device.

17. The hat and holder combination of claim 16, wherein the coupling device comprises a magnet.

18. The hat and holder combination of claim 10, further comprising a microfiber cloth mounted to a rear surface of the platform.

19. The hat and holder combination of claim 10, further comprising an eyeglass frame located between the platform and the crown of the hat.

* * * * *